United States Patent [19]

McGowen

[11] Patent Number: 4,534,555

[45] **Date of Patent: * Aug. 13, 1985**

[54] THERAPEUTIC DEVICE FOR A HUMAN BODY

[76] Inventor: Wayne H. McGowen, 4930 Mill Creek, Dallas, Tex. 75234

[ * ] Notice: The portion of the term of this patent subsequent to Mar. 27, 2001 has been disclaimed.

[21] Appl. No.: 549,272

[22] Filed: Nov. 3, 1983

Related U.S. Application Data

[63] Continuation of Ser. No. 349,451, Feb. 17, 1982, Pat. No. 4,438,761, which is a continuation-in-part of Ser. No. 324,133, Nov. 23, 1981, abandoned.

[51] Int. Cl.[3] ..... A63B 17/00

[52] U.S. Cl. ..... 272/145; 128/75; 128/71

[58] Field of Search ..... 128/24 R, 71, 75; 272/145, 62

[56] References Cited

U.S. PATENT DOCUMENTS

| | | | |
|---|---|---|---|
| 1,693,810 | 12/1928 | Daniels et al. | 128/70 |
| 2,594,605 | 4/1952 | Zoppelt | 272/62 X |
| 3,142,307 | 7/1964 | Danciart et al. | 403/108 X |
| 3,286,708 | 11/1966 | Gartner | 128/24 R |
| 3,568,669 | 3/1971 | Stites | 128/71 |
| 3,707,285 | 12/1972 | Martin | 272/62 |
| 4,170,988 | 10/1979 | Krause | 128/24 R |
| 4,232,662 | 11/1980 | Barber | 128/71 |
| 4,367,731 | 1/1983 | Barber | 128/71 |

*Primary Examiner*—Richard J. Apley
*Assistant Examiner*—David J. Brown
*Attorney, Agent, or Firm*—Hubbard, Thurman, Turner & Tucker

[57] ABSTRACT

A therapeutic device for treating and exercising the human body by suspending the body in an inverted position. The device includes a body supporting platform that is pivotally mounted on a fulcrum and adjustably coupled to a lower body supporting portion. The lower body supporting portion includes a first support arranged to extend under the arch portion of each foot. A second support is positioned to engage the heel portion of each foot and acts with a movable third support which engages the instep portion of each foot. The third support is mechanically biased to grasp and automatically restrain each foot upon pivotal displacement of the body supporting platform from a substantially upright position.

8 Claims, 7 Drawing Figures

THERAPEUTIC DEVICE FOR A HUMAN BODY

CROSS REFERENCE TO RELATED APPLICATIONS

This application is a continuation of Ser. No. 349,451, filed Feb. 17, 1982, now U.S. Pat. No. 4,438,761, issued Mar. 27, 1984, which is a continuation-in-part of U.S. patent application Ser. No. 324,133, filed Nov. 23, 1981, now abandoned.

BACKGROUND OF THE INVENTION

This invention relates to devices for the therapeutic treatment of the human body in general and in particular to therapeutic devices for inverting the human body.

It has heretofore been generally known that certain therapeutic devices, if properly designed, can produce desirable and healthful therapeutic effects upon the human body. In particular, one class of such devices are those devices which are utilized to support the human body in an inverted position. Supporting the human body in an inverted position has the effect of counteracting the natural forces of gravity upon the body. The force of gravity produces many adverse effects upon the human body over a period of time, including: stooped shoulders, shortened spine, varicose veins and swollen ankles.

Supporting the human body in an inverted position tends to produce a lengthening along the longitudinal axis of the body, separating various joints and vertebrae and improving circulatory exchange and overall posture. Additionally, exercise during such inversion can prove especially beneficial in strengthening back and stomach muscles.

Prior art therapeutic devices are known which support the human body in an inverted position. Such devices generally use a restraining apparatus which must be manually adjusted to restrain the ankles of the operator. Other devices utilize individual boots or shoes which also must be carefully adjusted and secured to the feet of the operator. These devices have many common shortfalls such as the limited ability to accommodate various body sizes and the difficulty encountered in safely and comfortably restraining the ankles of the operator. The typical operator of such a device suffers from ailments of the back and cannot easily bend or contort as is typically necessary to engage a known ankle restraining device. Additionally, the safety aspect of any manual locking device is always subject to human error. The likelihood of inverting a patient without properly securing his lower extremities looms as a strong possibility with all known state of the art devices.

SUMMARY OF THE INVENTION

It is therefore one object of the present invention to provide an improved therapeutic device for supporting the human body in an inverted position.

It is another object of the present invention to provide an improved therapeutic device for supporting the human body in an inverted position which automatically restrains the ankles of the operator upon pivotal displacement of the support platform.

It is yet another object of the present invention to provide an improved therapeutic device for supporting the human body in an inverted position which includes means for adjusting the longitudinal axis of the device.

The foregoing objects are achieved as is now described. The therapeutic device includes a body supporting platform that is pivotally mounted on a fulcrum and adjustably coupled to a lower body supporting portion. The lower body supporting portion includes a first support arranged to extend under to arch portion of each foot. A second support is positioned to engage the heel portion of each foot and acts with a movable third support which engages the instep portion of each foot. The third support is mechanically biased to grasp and automatically restrain each foot upon pivotal displacement of the body supporting platform from an upright position.

BRIEF DESCRIPTION OF THE DRAWINGS

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

Figure 3:
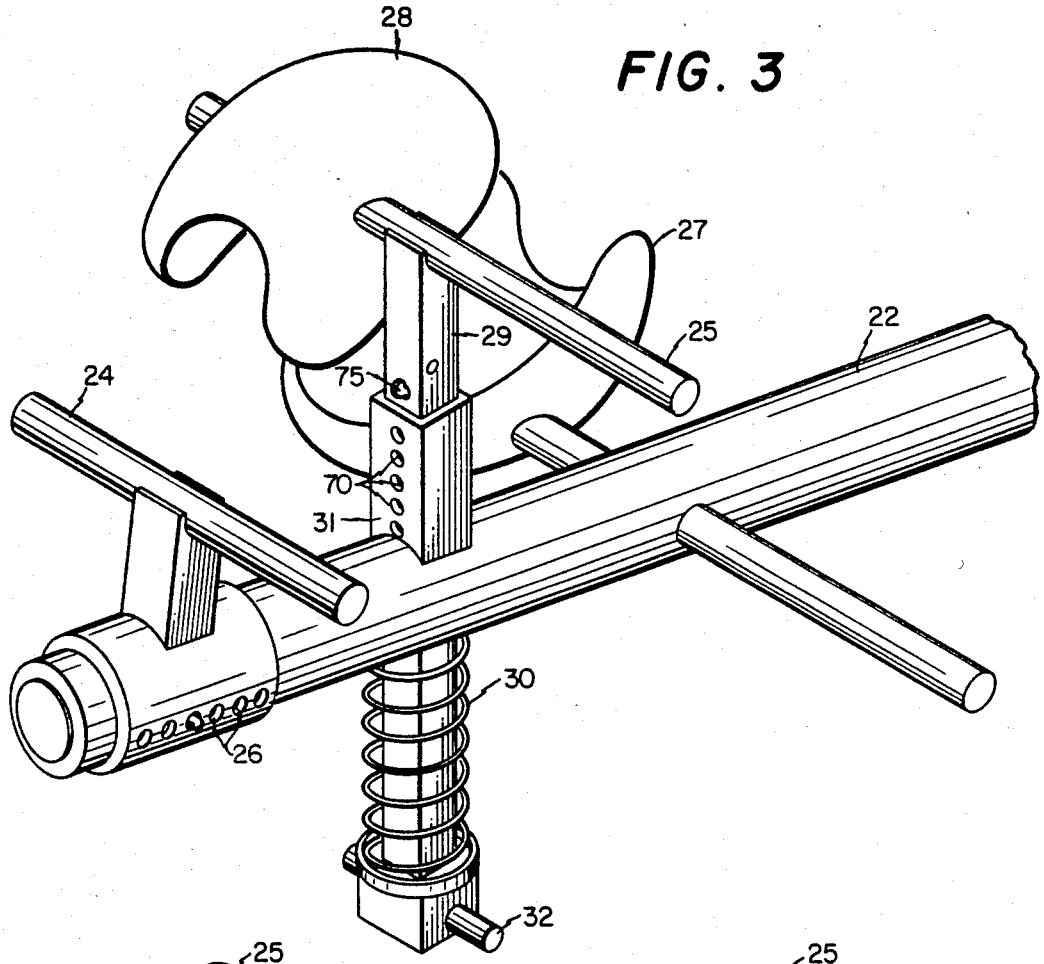
Figure 5:
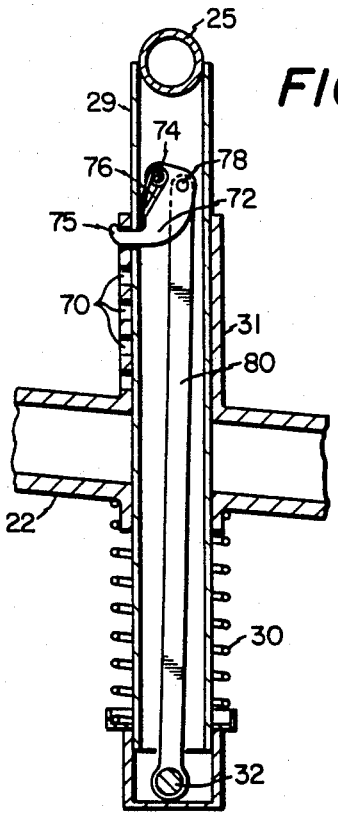
Figure 4:
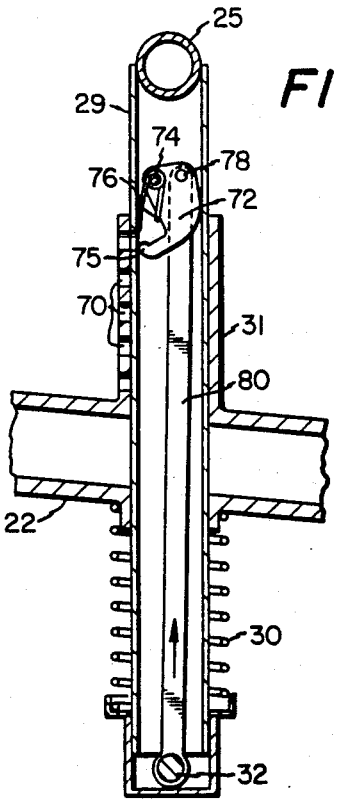

FIGS. *2a*, *2b* and *2c* are side views of the therapeutic device of the present invention showing the action of the automatic ankle locking device;

FIG. 3 is a perspective view of the ankle locking mechanism of the therapeutic device of the present invention;

FIG. 4 is a sectional view of the ankle locking mechanism of the therapeutic device of the present invention in the unlocked position; and FIG. 5 is a sectional view of the ankle locking mechanism of the therapeutic device of the present invention in the locked position.

DETAILED DESCRIPTION OF THE INVENTION

Figure 1:
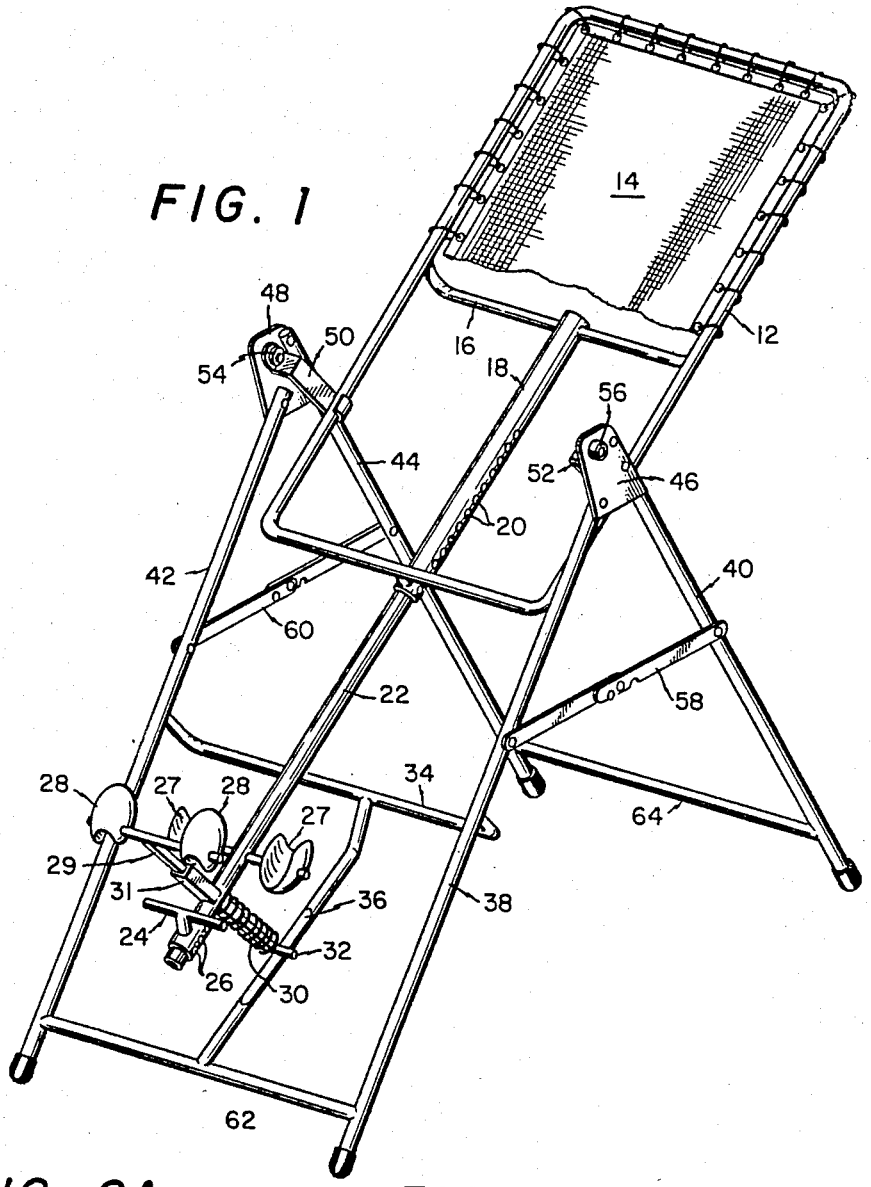
FIG. 1 is a perspective view of the therapeutic device of the present invention.
Figure 2A:
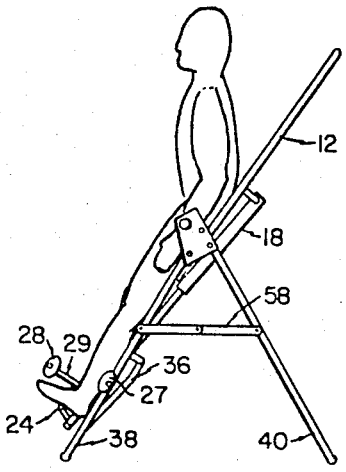
Figure 2B:
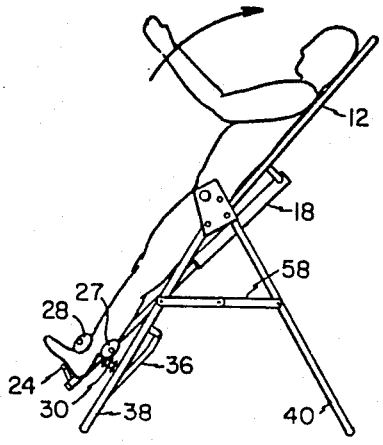
Figure 2C:
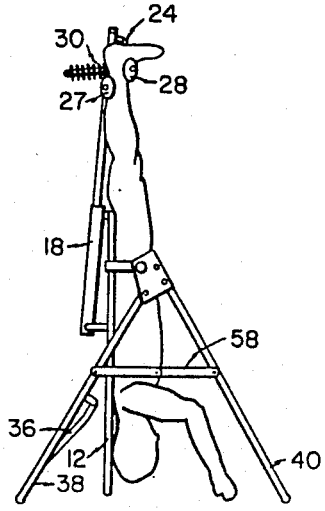

With reference now to the figures and in particular with reference to FIG. 1 there is depicted a perspective view of therapeutic device 10 of the present invention. Therapeutic device 10 includes a body supporting platform which is comprised of tubular frame 12 and fabric support 14. Tubular frame 12, as well as the remaining tubular sections of therapeutic device 10, may be constructed, in a preferred embodiment, of carbon steel, aluminum, or other metallic material of suitable rigidity. Fabric support 14 may be implemented utilizing canvas nylon duck or other suitable material.

Tubular frame 12 is mounted to longitudinal support 18 by means of transverse support 16. Longitudinal support 18 includes a plurality of holes or apertures 20 and is open at the lower end thereof in order to receive lower body support 22. Lower body support 22 includes protuberances, which are not shown, which engage selected apertures 20 to allow for rapid and simple longitudinal adjustment of lower body support 22.

Arch support 24 is mounted at the lower end of lower body support 22 in a manner similar to the coupling of lower body support 22 and longitudinal support 18. Arch support 24 includes a plurality of apertures 26 which permit adjustment of the position of arch support 24 on the lower end of lower body support 22. Lower body support 22 also includes heel supports 27. Heel supports 27 are molded pliable support members which are fixedly mounted to lower body support 22 and are formed, in a preferred embodiment, of a suitable plastic or rubber material such as neoprene or urethane elastomers.

Instep supports 28 are slidably mounted to lower body support 22 by means of interior shaft 29 and mounting shaft 31. Mounting shaft 31 is mounted to lower body support 22 at an angle of between 5° and 10° to ensure reliable ankle restraint in a manner explained herein. Instep supports 28 consist of a pair of pliable supports adapted to surroundingly engage the instep portion of the human foot. Instep supports 28 are also constructed of a pliable plastic or rubber material such as neoprene or urethane elastomers, in the preferred embodiment.

Instep supports 28 are biased toward heel supports 27 by means of spring 30. Trigger 32 of interior shaft 29 is designed to interact with striker bar 36 to automatically overcome the mechanical bias provided by spring 30 at those times when the body supporting platform is in the upright position. Striker bar 36 is mounted to the support fulcrum of therapeutic device 10 by means of transverse supports 34 and 62.

The body supporting platform of therapeutic device 10 is pivotally mounted at bearings 54 and 56 by means of support arms 50 and 52. Support arms 50 and 52 are, in a preferred embodiment of the present invention, welded to tubular frame 12 and provide a secure mounting for the body supporting platform. Bearings 54 and 56 are mounted within support plates 46 and 48. Support plates 46 and 48 serve as a pivoting mounting point for fulcrum support legs 38, 40, 42 and 44. Brackets 58 and 60 serve to limit the pivoting of fulcrum support legs 38, 40, 42 and 44 and also serve to increase the stability of the resultant fulcrum. Those ordinarily skilled in the art will appreciate that the interaction of the pivotal mounting of fulcrum support legs 38, 40, 42 and 44 with brackets 58 and 60 will permit therapeutic device 10 to be compactly folded for ease of storage.

With reference now to FIGS. *2a*, *2b* and *2c* there is depicted a side view of the novel therapeutic device 10 of the present invention demonstrating the automatic ankle restraining feature of the present invention. In FIG. *2a*, an operator of the device is shown resting on the body supporting platform with his feet upon arch support 24. Heel supports 27 are fixedly mounted on lower body support 22 in a position to surroundingly engage the heel portion of each of the operator's feet. Instep supports 28 are shown distended from the instep of the operator's feet due to the interaction of trigger 32 of interior shaft 29 and striker bar 36 in overcoming the bias provided by spring 30.

In FIG. *2b*, as the operator raises his arms and shifts his center of gravity, the body supporting platform of the therapeutic device 10 rotates in a clockwise manner, and instep supports 28 are urged to a position which surroundingly engages the instep of each of the operator's feet by the action of spring 30. As trigger 32 of interior shaft 29 is rotated out of contact with striker bar 36, spring 30 serves to urge instep supports 28 into contact with the instep of each of the operator's feet and to operate the ankle lock mechanism of the present invention.

In FIG. *2c*, therapeutic device 10 is shown in the fully inverted position. The ankles of the operator are securely restrained by the interaction of heel supports 27 and instep supports 28. Experimentation has demonstrated that the clockwise torque exerted upon heel supports 27 and instep supports 28 by the natural leverage of the human foot will serve to prevent instep supports 28 from slipping in response to the weight of the operator. Additionally, the slight angular mounting of mounting shaft 31 (exaggerated slightly in FIGS. *2a*, *2b* and *2c*) also ensures firm restraint of the operator's ankles by providing an extra restraining force due to the lateral force exerted upon interior shaft 29 by the body weight of the operator. To positively ensure firm restraint of the operator's ankles, a positive action locking mechanism is provided which will be explained in detail below. In an alternate embodiment, interior shaft 29 of instep supports 28 may be slightly serrated to mate with similar serrations within mounting shaft 31, thus ensuring rigidity and firmness of restraint on the ankles of the operator of the therapeutic device.

Upon rotation of therapeutic device 10 to the upright position, trigger 32 of interior shaft 29 will once again contact striker bar 36, compressing spring 30 and urging instep supports 28 to the release position depicted in FIG. *2a*.

Referring now to FIG. 3, there is depicted a perspective view of the positive locking mechanism of the ankle lock of the present invention. As can be seen in FIG. 3, a plurality of apertures 70 is provided in mounting shaft 31. A cam surface 75 within interior shaft 29 is selectively operated to engage a particular one of said plurality of apertures 70 and provides a positive lock position for instep supports 28 with respect to heel supports 27.

The operation of the positive locking mechanism of the ankle lock depicted in FIG. 3 can be illustrated by reference to FIGS. 4 and 5. FIG. 4 is the sectional view of the ankle locking mechanism of the present invention which depicts the mechanism which operates cam surface 75. Cam surface 75 is shown as an elongated portion of cam 72 which is pivotally mounted about axis 74. Spring 76 is utilized to urge cam 72 in the counterclockwise direction about axis 74, thus urging cam surface 75 out of the aperture provided in interior shaft 29 and away from contact with a selected one of apertures 70.

Actuating lever 80 is pivotally mounted to cam 72 about axis 78 and serves as a mounting point for trigger 32. The interaction of trigger 32 with striker bar 36 (not shown) overcomes the mechanical bias provided by spring 30 and urges actuating lever 80 in an upward direction rotating cam 72 to the position depicted in FIG. 4.

With reference now to FIG. 5, the ankle locking mechanism of the present invention is shown in the locked position. In this position, lower body support 22 has been rotated to the point where trigger 32 is no longer in contact with striker bar 36 (not shown) and spring 30 has biased trigger 32 in the downward direction. The downward movement of trigger 32 causes in a downward movement of actuating lever 80, thus rotating cam 72 in a clockwise direction. In this manner, cam surface 75 is rotated into a selected one of apertures 70. The design of cam surface 75 is such that shaft 25, which supports instep supports 28, may be urged in the downward direction to more tightly grasp the ankles of the operator; however, shaft 25 may not be moved in the upward direction until such time as trigger 32 has contacted striker bar 36 and actuating lever 80 has rotated cam 72 to the position depicted in FIG. 4. Thus, those skilled in the art will appreciate that the novel therapeutic device depicted herein will act to automatically and securely restrain the ankles of an operator thereof upon pivotal displacement of the body support platform from the upright position. In this manner, it becomes apparent that it should be impossible to invert the human body within therapeutic device 10 of the present invention without firmly locking the ankles of the operator within the device, thus ensuring the safety of the operator.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications of embodiments that fall within the true scope of the invention.

What is claimed is:

1. A therapeutic apparatus for the human body comprising:

an elongated planar platform adapted to support the upper body in a reclining position, said platform being pivotally mounted on a fulcrum wherein said platform is pivotally displaceable about an axis transversed to the longitudinal axis of said platform;

a lower body support connected to said platform by an elongated frame member, said lower body support including:

a first support means mounted on said lower body support and positioned to extend under each foot;

a second support means fixedly mounted on said lower body support and positioned to surroundingly engage a first portion of each foot;

a first mounting shaft fixedly mounted to said lower body support;

a second mounting shaft slidably disposed in telescoping fashion within said first mounting shaft;

a third support means mounted to said second mounting shaft and adapted to surroundingly engage a second portion of each foot and fixedly restrain each foot while disposed proximate to said second support means and adapted to release each foot while disposed distal to said second support means; and biasing means for urging said third support means toward said second support means.

2. The therapeutic apparatus according to claim 1 wherein said elongated planar platform comprises a tubular frame which includes a fabric surface mounted thereupon.

3. The therapeutic apparatus according to claim 2 wherein said tubular frame is comprised of carbon steel tubing.

4. The therapeutic apparatus according to claim 1 wherein said first support means includes means for adjustably mounting said first support means to said lower body support whereby said first support means may be mounted in a plurality of discrete positions.

5. The therapeutic apparatus according to claim 1 wherein said biasing means comprises a metal spring.

6. A therapeutic apparatus for the human body comprising:

an elongated planar platform adapted to support the upper body in a reclining position, said platform being pivotally mounted on a fulcrum wherein said platform is pivotally displaceable about an axis transversed to the longitudinal axis of said platform;

a lower body support connected to said platform by an elongated frame member, said lower body support including:

a first support means mounted on said lower body support and positioned to extend under each foot;

a second support means fixedly mounted on said lower body support and positioned to surroundingly engage a first portion of each foot;

a first mounting shaft fixedly mounted to said lower body support;

a second mounting shaft slidably disposed in telescoping fashion within said first mounting shaft;

a third support means mounted to said second mounting shaft and adapted to surroundingly engage a second portion of each foot and fixedly restrain each foot while disposed proximate to said second support means and adapted to release each foot while disposed distal to said second support means;

biasing means for urging said third support means toward said second support means; and locking means for selectively restricting relative movement between said first mounting shaft and said second mounting shaft.

7. The therapeutic apparatus for the human body according to claim 6 wherein said locking means comprises a lever actuated cam surface lock and means for rotating said cam surface into a locked position.

8. The therapeutic apparatus for the human body according to claim 6 wherein said first mounting shaft and said second mounting shaft have substantially rectangular cross sections.

* * * * *